US006270007B1

(12) United States Patent
Jensen, Jr.

(10) Patent No.: US 6,270,007 B1
(45) Date of Patent: Aug. 7, 2001

(54) STACKABLE TRANSPORT CRATE

(75) Inventor: Robert F. Jensen, Jr., Apple Valley, MN (US)

(73) Assignee: Cherokee Manufacturing, South St. Paul, MI (US)

( * ) Notice: Subject to any disclaimer, the term of this patent is extended or adjusted under 35 U.S.C. 154(b) by 0 days.

(21) Appl. No.: 09/382,220

(22) Filed: Aug. 24, 1999

(51) Int. Cl.[7] ..... B65D 5/488

(52) U.S. Cl. ..... 229/122.21; 229/120; 229/120.29; 229/122.3

(58) Field of Search ..... 229/120, 120.26, 229/120.29, 122.21, 122.3, 916; 47/84

(56) References Cited

U.S. PATENT DOCUMENTS

| | | | | |
|---|---|---|---|---|
| 1,767,629 | * | 6/1930 | Walter | 229/122.3 |
| 1,990,829 | | 2/1935 | Jensen . | |
| 2,341,374 | * | 2/1944 | Gardner | 47/84 |
| 2,643,810 | | 6/1953 | Fleming . | |
| 3,028,005 | | 4/1962 | Shaffer | 206/65 |
| 3,108,569 | * | 10/1963 | Kundikoff | 229/120 |
| 3,291,364 | | 12/1966 | Fischer . | |
| 3,347,356 | | 10/1967 | Kossnar | 206/45.29 |
| 3,348,667 | * | 10/1967 | Beeby | 229/120.26 |
| 3,379,304 | | 4/1968 | Mertz | 206/65 |
| 3,656,611 | | 4/1972 | Mertz . | |
| 3,921,893 | * | 11/1975 | Randle, Jr. | 229/122.21 |
| 4,148,427 | | 4/1979 | Baker . | |
| 4,171,059 | | 10/1979 | Heller et al. | 220/4 |
| 5,141,149 | | 8/1992 | Fulton | 229/103 |
| 5,265,797 | | 11/1993 | Velge et al. | 229/125.26 |
| 5,337,950 | | 8/1994 | Bower | 229/164 |
| 5,520,325 | * | 5/1996 | Quaintance | 229/120.26 |
| 5,950,911 | * | 9/1998 | Naughton et al. | 229/122.3 |

* cited by examiner

*Primary Examiner*—Gary E. Elkins
(74) *Attorney, Agent, or Firm*—Harold D. Jastram; Steven C. Lieske; Oppenheimer Wolff & Donnelly

(57) ABSTRACT

A stackable crate for transporting potted plants and the like includes opposing trays spaced apart by support structures. The trays form a top and bottom for the stackable crate. Each of the trays have side walls and end walls. The side walls are orthogonal to the end walls to thereby define four corners for the opposing trays. Each of the support structures has a plurality of upstanding panels which define interior and exterior walls for the stackable crate. Two of the upstanding panels are parallel and joined at their ends by one other upstanding panel of the plurality of upstanding panels so to form corners for the support structures. At least one of the corners so formed is an exterior corner for the stackable crate. The support structures are configured relative to the opposing trays such that each of the exterior corners are in substantial abutting alignment with each of the corners of the opposing trays to thereby form substantially closed ends and partially open sides for the stackable crate. The partially open sides facilitate access to the interior storage space of the stackable crate and enhance air flow therethrough.

21 Claims, 2 Drawing Sheets

12
36
36
34
32
30
10
24
38a
46
26
18
38b
22a
20
38a
16
16
44
38b
40
39
22b
28
32
14
42
46
30
36
36
34

14
26
5
30
36
39
16
46
5
22
40
4
4
24
18
28
32
24
38a
16
20
39
42
38b
18
22
36
36
34

14
26
30
32
39
16
46
22
40
18
20
45
28
24
20
24
38a
16
39
42
18
38b
34
36
36

STACKABLE TRANSPORT CRATE

TECHNICAL FIELD

The present invention relates to containers used in the transport and storage of horticultural items, and more particularly to a stackable crate for transporting potted plants that is strong, light-in-weight and capable of easy set up, break down and recycling.

BACKGROUND OF INVENTION

The distribution of bedding plants, small woody plants, potted plants, and other nursery stock begins at the grower. Growers of such horticultural items, as any supplier of goods, need to cost effectively get their goods to market without sacrificing product quality.

Horticultural and agricultural items such as trees, shrubs, bushes, vines etc. are transported in a potted condition. Although it is not unheard of to transport plants in ten gallon or greater capacity planters, one to seven gallon planters are most commonly encountered. Such potted plants were commonly "floor loaded" inside cargo trucks (i.e., hand loaded to form a staggeredly stacked arrangement whereby the foliage of each plant is pushed aside or otherwise manipulated so as to accommodate a successive layer of potted plants positioned thereover). In addition to being labor intensive, this method caused a great deal of plant damage. Presently, large metal racks are now widely used for transporting potted plants. The potted plants are loaded into the bulky, heavy metal racks which are then placed into trucks and transported to garden supply stores or other retail outlets. Upon arrival at the retail outlet, the plants are typically unloaded and displayed in the cumbersome transport racks, or loaded into a more consumer appealing point of display rack.

Various types and configurations of paperboard or corrugated paperboard shipping containers have been developed in attempts to reduce the reliance on expensive and inconvenient metal shipping racks. Unfortunately, known paperboard containers have several shortcomings. For instance, a majority of such containers are designed for holding nursery flats, and as such are ill suited for transporting the larger, taller, bulkier and substantially heavier potted plants. Furthermore, known transport containers are little more than fully enclosed cardboard boxes, generally providing a poor environment (i.e., dark, cramped, no or low air circulation etc.) for the storage of a product which is especially sensitive to its environment, and whose saleability is greatly a function of appearance and health. Another disadvantage associated with paperboard shipping containers is that they are usually relatively difficult, thus expensive, to assemble, often times requiring glue, tape, staples etc. to maintain the origami-like folds frequently present in such box constructions.

As a testament to their overall shortcomings, it is still common to transport potted plants using the cumbersome and heavy metal racks in lieu of or in addition to paperboard shipping containers, in part because the paperboard containers are usually not strong enough to allow the stacking of containers one on top of another. In addition to handling issues, the reality is that the metal racks comprise a substantial portion of the total shipped weight sent by a grower, and therefore unavoidably represent a significant cost of the shipped product. Furthermore, the metal racks must be returned empty (i.e., "dead headed") to the growers before they can be used again, which results in substantial return shipping costs, costs which are again ultimately reflected in the price of the product in the market place.

SUMMARY OF THE INVENTION

The present invention provides a strong, light weight stackable crate for transporting potted plants that is both user and plant friendly. The stackable transport crate of the present invention includes opposing trays spaced apart by support structures. The trays form a top and bottom for the stackable crate. Each of the trays have side walls and end walls. The side walls are orthogonal to the end walls to thereby define four corners for the opposing trays. Each of the support structures has a plurality of upstanding panels which define interior and exterior walls for the stackable crate. Two of the upstanding panels are parallel and joined at their ends by one other upstanding panel of the plurality of upstanding panels so as to form corners for the support structures. At least one of the corners so formed is an exterior corner for the stackable crate. The support structures are configured relative to the opposing trays such that each of the exterior corners are in substantial abutting alignment with each of the corners of the opposing trays to thereby form substantially closed ends and partially open sides for the stackable crate. The partially open sides facilitate access to the interior storage space of the stackable crate and enhance air flow therethrough. More specific features and advantages will become apparent with reference to the DETAILED DESCRIPTION OF THE INVENTION, appended claims, and the accompanying drawing figures.

DETAILED DESCRIPTION OF THE DRAWINGS

Figure 1:
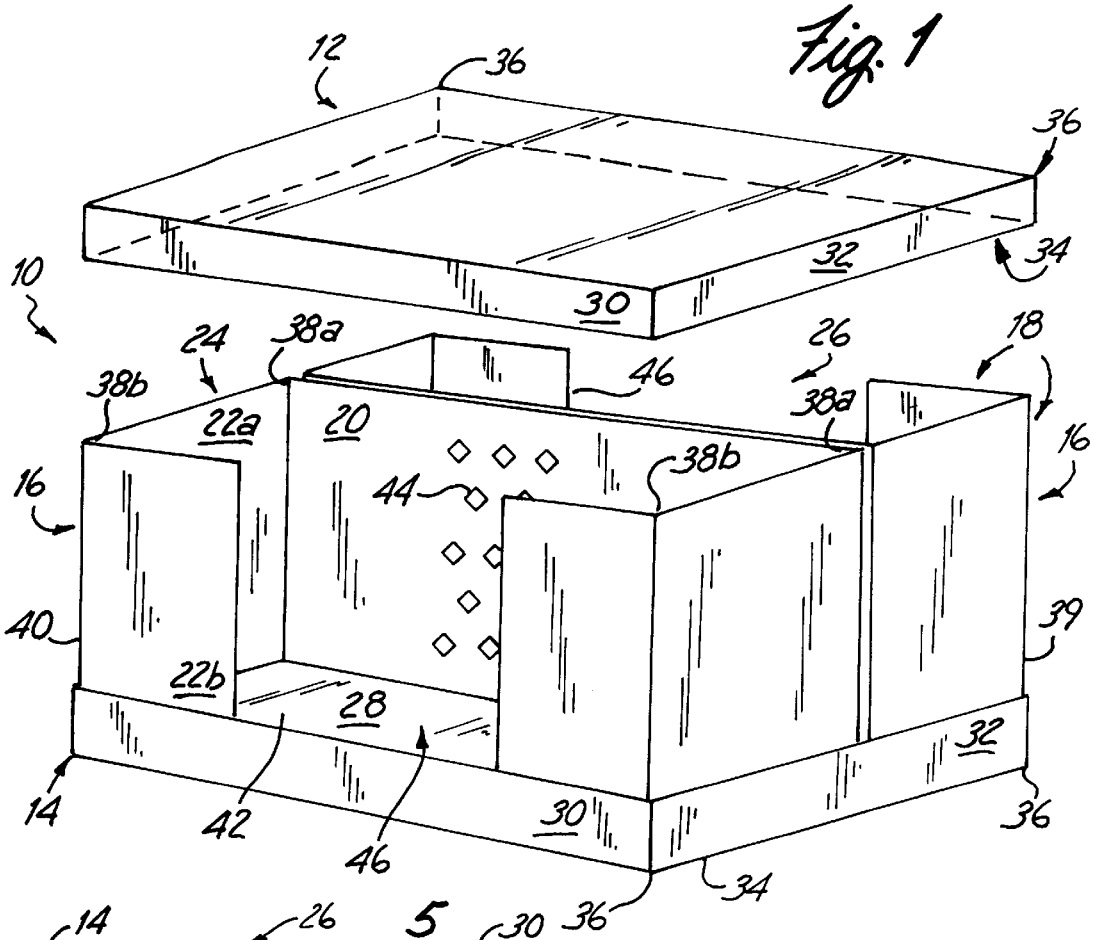
FIG. 1 is an exploded perspective side view of the stackable transport crate of the present invention.

Referring to FIG. 1, there is shown, consistent with the present invention, a paperboard transport crate 10 of rectangular geometry for transporting and temporarily storing potted plants and the like. Opposing trays 12 & 14, forming a top and bottom for the stackable transport crate 10, are spaced apart by support structures 16 comprising a plurality of upstanding panels 18 which define interior 20 and exterior walls 22 for the stackable transport crate 10. The support structures 16 are individually configured and aligned with respect to each other and the trays so as to form substantially closed ends 24 and partially open sides 26 for the stackable transport crates 10. The partially open sides 26 of the crate 10 facilitate access to the interior storage space 28 and enhance air flow to and through the stackable transport crate 10.

The top 12 and bottom 14 crate trays each have side walls 30 and ends walls 32 that define a rim 34 for each of the trays. The side walls 30 are orthogonal to the end walls 32 and thereby define four corners 36 for each of the opposing trays. As the crate is preferably but not necessarily rectangular, the trays are rectangular, with the length of the tray side walls 30 being greater than the length of the tray end walls 32. The rim 34 of the tray is preferably a uniform height, and in all events is configured sufficiently to snugly engage and contain top and bottom portions of the support structures 16, thereby establishing and maintaining the angular relationships between the support structures themselves and between the support structures and the trays.

Generally, two of the upstanding panels 18 of each of the support structures 16 are parallel and joined at their ends by one other upstanding panel of the plurality of upstanding panels so as to form corners 38 for the support structures 16. At least one of the support structure corners 38 is an exterior corner 40 for the stackable transport crate 10. The support structures 16 are arranged relative to the opposing trays 12 & 14 such that each of the exterior corners 40 of the support structures 16 are in substantial abutting alignment with each of the corners 36 of the opposing trays. The support structures 16 effectively divide the crate into longitudinally parallel spaces 42 for receiving items for transport, namely potted plants.

Figure 2:
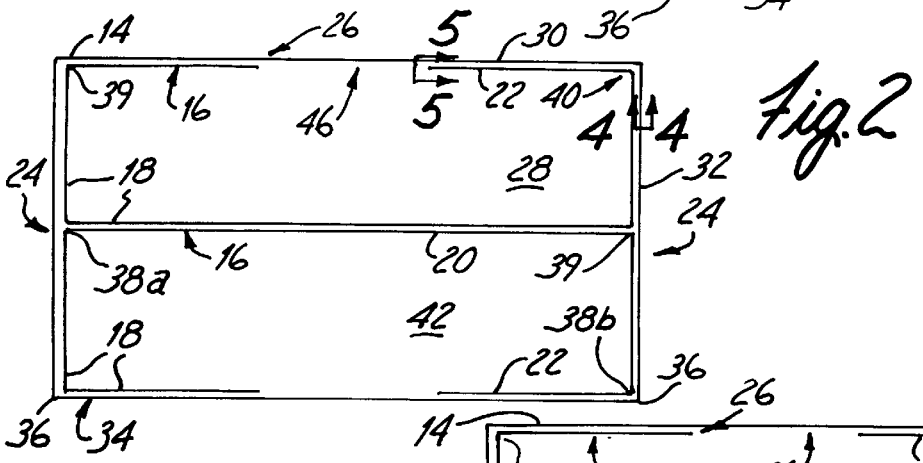
FIG. 2 is a top view into the interior space of an empty crate, the lid having been removed, particularly illustrating the support structure configuration and arrangement.

Referring now to FIGS. 1 & 2, two opposingly abutting support structures are present in the preferred embodiment, each support structure 16 having a total of five upstanding wall panels 18. With this support structure configuration, both of the parallel upstanding panels of each of the structures define opposing exterior end walls 22*a* which are joined together or linked by a major upstanding center panel 20 (i.e., an interior upstanding panel that traverses the end walls 32 of the opposing four cornered trays to thereby define a traversing interior wall for the crate). The traversing interior wall 20 has a plurality of openings 44 therethrough, generally located within or about the center third of the panel, which permit cross ventilation of the crates. Extending towards each other from the ends of the opposing exterior end walls 22*a*, opposite the traversing interior wall 20 and parallel thereto, are the remaining upstanding panels 18 which form partial exterior side walls 22*b* (i.e., wall segments), and thereby define a passage 46 into the interior storage space 28 of the stackable crate 10. This passage 46 aids in maintaining the quality of the potted plants, while crated, by fostering photosynthesis; specifically by providing easy access for watering, permitting light to reach the foliage of the potted plants and, by providing air circulation and ventilation necessary to sustain plant health during transport, particularly in combination with the openings in the transverse interior wall.

The parallel upstanding panels of the preferred embodiment (i.e., exterior end wall segments 22*a*) are generally dimensioned to be about one half of the distance between the side walls 30 of the opposing trays such that the opposingly abutting support structures form substantially closed ends 24 for the stackable transport crate 10. The major upstanding center panel (i.e., traversing interior wall 20) is dimensioned in substantial conformity with the longitudinal dimension of the crate trays (i.e., sidewall dimension), whereas the remaining upstanding wall panels (i.e., exterior sidewall segments 22*b*) are each dimensioned to be within a preferred range of about 25% to 45% of the longitudinal dimension of the crate trays. Among other things, the aim or function of the exterior sidewall segments 22*b* is to provide structural support between opposing tray side walls while providing a significant rim to rim passage for interior storage space access and air flow.

Interior and exterior corners 38*a* & 38*b*, and corner posts 39, defined by the intersecting upstanding wall panels, strengthen the stackable transport crate perimeter, with the abutting transverse interior walls 20 of adjacent support structures 16 providing a structural member within and through the stackable crate 10. The interior 20 and exterior 22 walls of the support structures vis-a-vis the corner posts 39 allow stacking of loaded transport crates while facilitating access to the crate contents from either the front or rear (i.e., longitudinal crate faces or sides) without unstacking the crates for access via tray removal.

Figure 2A:
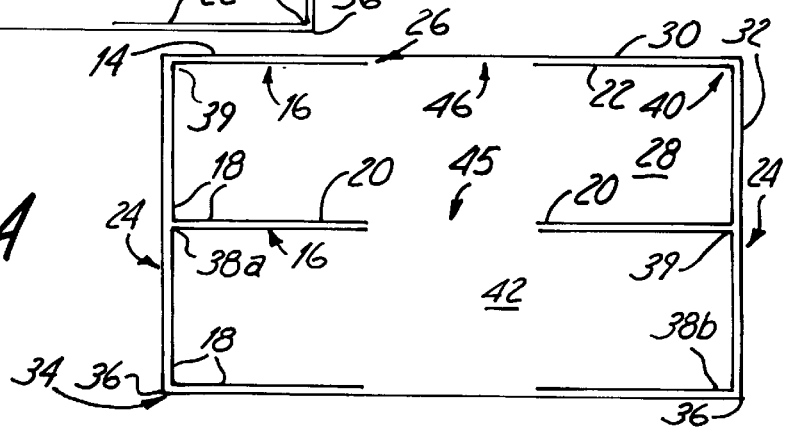
FIG. 2A is a top view into the interior space of an empty crate, the lid having been removed, particularly illustrating an alternate support structure configuration and arrangement.

Referring now to FIG. 2A, an alternate support structure configuration and resulting arrangement is shown. Four support structures, each having a total of three upstanding wall panels 18 are provided and arranged so as to divide the crate space and thereby define and "bracket" longitudinally parallel crate storage spaces 42. Here one of the parallel upstanding wall panels (i.e., bracket arms) forms an interior wall segment 20 and the other of the parallel upstanding wall panels forms an exterior sidewall segment 22*b*. The exterior end wall segment 22*a*, which links the interior 20 and exterior sidewall segment 22*b*, is generally dimensioned as in the case of the preferred embodiment (i.e., about one half of the distance between the side walls of the opposing trays) such that substantially closed ends 24 are thereby formed for the crate. The parallel wall segments of the support structures may be dimensioned equally, generally being about 25% to 45% of the longitudinal dimension of the trays (i.e., the distance between the end walls of the opposing trays), however, it is desirable to have the interior wall segment 20 dimensioned greater than its parallel counterpart (i.e., partial exterior side wall segment 22*b*). Preferably the length of each of the interior wall segments 20 is about 45% of the longitudinal dimension of the trays such that maximum longitudinal support is provided for the crate by the interior wall segments 20 extending towards each other from opposing tray end walls 32 without actually traversing the distance between the end walls 32 of the opposing trays (i.e., physically linking them). By this support structure geometry and arrangement, an internal ventilation path 45 for the crate is provided by the interior wall segments 20 of a bracket pair of support structures which approach each other but do not connect, so as to effectively form an open interior center wall for the crate. Partially open sides 26 for the stackable transport crate 10 are formed, as in the case of the preferred embodiment, by the opposingly abutting support structures.

The stackable transport crate of the subject invention is preferably fabricated from a recyclable corrugated cardboard stock (i.e., two pieces of paperboard spaced apart by characteristic arches of wavy fluting lying therebetween). The corrugated cardboard stock is ideally treated so as to be substantially water resistant, thus insuring sufficient rigidity and durability for the crate components throughout a variety of ground and transport environments. Such water resistant coatings (e.g., those produced and sold by Michelman, Inc., for instance Coating X300™, Michem® Coat 40 Series etc.) are well known to those of skill in the paper board coating art, and generally should be selected so as to maintain rigidity and thereby stacking strength for the crates while likewise permitting recycling post use.

Figure 3:
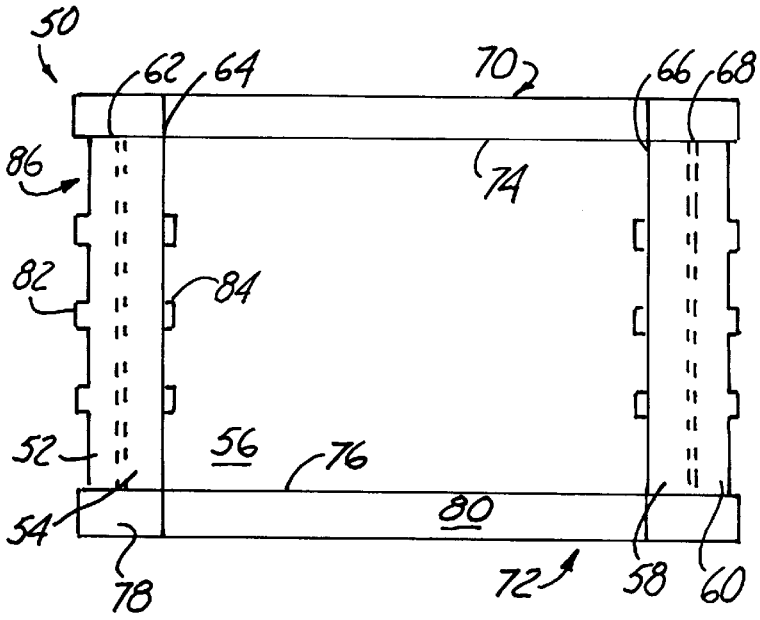
FIG. 3 is a plan view of a blank construction for making the trays of the crate of the present invention.

Referring now to FIG. 3, a typical blank structure 50 for the trays of the stackable transport crate is shown. A plurality of panels 52, 54, 56, 58 & 60 are connected to one another along score lines 62, 64, 66 & 68. In addition, a pair of end panels 70 & 72 are foldably connected to the major tray panel 56 along score lines 74 & 76, with each of the end panels 70 & 72 being divided into a reinforcing panel 78 and a side rim 80. Panels 52 & 60 include spaced apart integral locking tabs 82 located along the free edges thereof. The blank 50 is completed with spaced apart locking slots 84, located upon score lines 64 & 66 between panels 64 & 66 and 66 & 68, for receiving the locking tabs 82. In setting up a tray, the reinforcing panels 78 of the blank 50 are first folded upwardly along extensions of score lines 64 & 66 and the side rims 80 are folded inwardly (i.e., toward each other) along score lines 74 & 76 such that a substantially open ended tray is formed. Next, the blank 50 is folded along score lines 62 & 68 and again along score lines 64 & 66 to cause the locking tabs 82 to become engaged in the opposingly aligned slots 84, thereby forming reinforced end rims 86 for the tray. In this condition, the tray is suited for either receiving the support structures as when used as a base, or for covering the support structures as when used as a lid.

Figure 4:
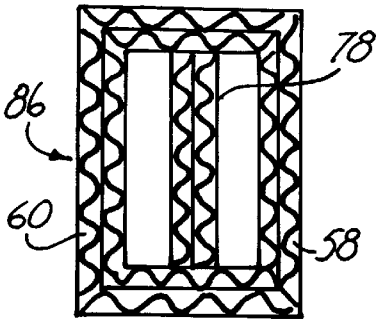
FIG. 4 is an exaggerated sectional view taken along line 4—4 of FIG. 3 showing a lateral edge construction for the tray in cross section.
Figure 5:
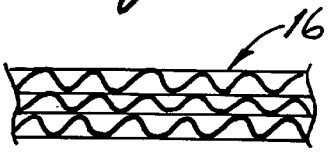
FIG. 5 is an exaggerated sectional view taken along line 5—5 of FIG. 2 showing a longitudinal edge construction for the tray in cross section.

As to wall thicknesses, the trays are preferably a two ply construct, having a total overall thickness in the range of about 0.25 to 0.5 inches for typical potted plant transport applications. FIG. 4 shows an exaggerated cross section of an end rim of the tray, particularly illustrating the reinforced corner panel 78 thereof. The support structures are preferably a three ply corrugated construct, as shown in FIG. 5, and generally have a total overall thickness in the range of about 0.5 to 1 inch for typical potted plant transport applications.

As previously noted, the crate traversing interior wall 20 has a plurality of openings 44 therethrough to permit ventilation of the stackable crates. As shown in FIG. 1, the openings 44 are positioned in the center portion of the interior wall 20, preferably comprising a plurality of staggered rows of spaced apart diamond like holes. The important consideration here is to provide openings through the traversing interior wall without sacrificing rigidity (i.e., jeopardizing the structural integrity of the panel).

Figure 6:
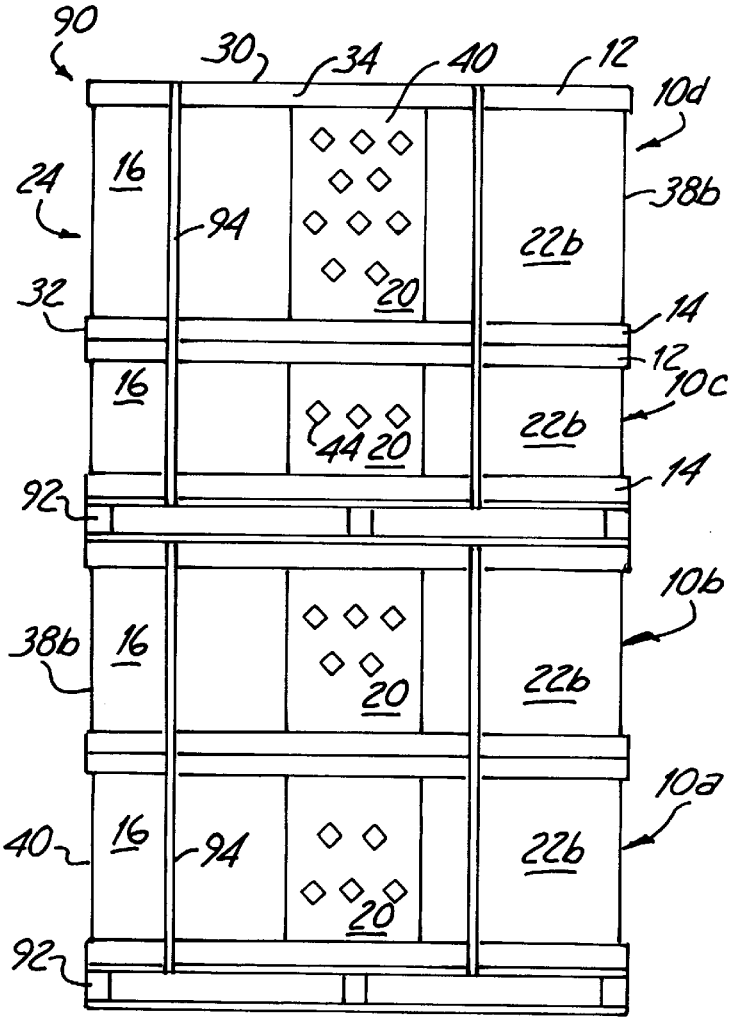
FIG. 6 is a side plan view of a plurality of crates, stacked as in a condition for transport.

Referring now to FIG. 6, a cargo bundle 90 is shown comprising four stackable crates 10*a*–10*d* in a stacked and bundled condition, as may be the case when loading a common carrier cargo box. A first set of piggybacked stackable crates lOa & lOb are positioned upon a pallet 92, here a "base" pallet, and are bound thereto using strapping 94. The "palletization" of the stackable crates using readily available pallets makes for supremely easy loading and unloading of the stacked crates. A second set of palletized piggybacked stackable crates 10*c* & 10*d* is shown stacked atop the first set. The overall height of the cargo bundle is predicated upon the available cargo height, which may typically be about eight feet. In the case where the crates have a substantially square geometry, it is not necessary to matchingly align each crate 10 of the bundle 90 with respect to each of the others (i.e., substantially closed crate ends 24 with each other or conversely the partially open sides 26 with each other).

The crates are preferably but not necessarily dimensioned in accordance with generally available pallets (e.g., 40"× 48", 42"×48", 48"×48" etc.). Potted plants of the one to five gallon variety (i.e., those having one to five gallon planters) are ideal, as their planter diameters (i.e., about 6 to 12 inches generally) permit an optimal balance of quantity and weight, with seven and ten gallon container being at the upper end of capacity for the stackable transport crates of the subject invention. Typically, about 8 to 16 potted plants per crate, easily several hundred pounds, may be stored for stacked transport, however, it should be noted that quantity limitations are highly variable, dependant upon such factors as foliage type, plant height, soil type, etc. Generally, a variety of support structure heights are optionally available for mixing and matching the wide variety of potted plants typically transported (i.e., plants having a variety of heights, see FIG. 6). Preferably the support structures are dimensioned in six inch height increments, from a minimum of 12" to a maximum of 36" (i.e., 12", 18", 24" and 36").

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A light weight stackable crate particularly suited for storing and transporting products, comprising:

(a) opposing trays forming a top and bottom for said stackable crate, each of said trays having side walls and end walls; and (b) a plurality of support structures separating said opposing trays, each of said support structures comprising a plurality of upstanding panels which define interior and exterior walls for said stackable crates, two of said upstanding panels being parallel and joined to one other upstanding panel of said plurality of upstanding panels which is a central panel, said support structures configured substantially perpendicular to said opposing trays such that at least one of said parallel upstanding panels is in substantial parallel and abutting alignment with a portion of at least one of said end walls to thereby form substantially closed ends and partially open sides for said stackable crate, said partially open sides facilitating access to an interior storage space of said stackable crate and enhancing air flow through said stackable crate.

2. The stackable crate of claim 1 wherein said trays and said support structures comprise corrugated cardboard.

3. The stackable crate of claim 1 wherein said plurality of support structures includes four support structures.

4. The stackable crate of claim 3 wherein said trays and said support structures are corrugated cardboard.

5. The stackable crate of claim 3 wherein one of said parallel upstanding panels is an interior wall, and the other of said parallel upstanding panels is an exterior wall.

6. The stackable crate of claim 1 wherein each of said support structures have a total of five upstanding wall panels.

7. The stackable crate of claim 6 wherein said trays and said support structures are corrugated cardboard.

8. The stackable crate of claim 6 wherein both of said parallel upstanding panels are exterior walls.

9. The stackable crate of claim 8 wherein said other upstanding panel joining said parallel upstanding panels traverses said opposing trays from one of said end walls to the other.

10. The stackable crate of claim 9 wherein said trays and said support structures are corrugated cardboard.

11. The stackable crate of claim 9 wherein said central panel has a plurality of openings therethrough.

12. The stackable crate of claim 11 wherein said plurality of openings are positioned throughout about the center third of said central panel.

13. A light weight stackable crate particularly suited for transporting and temporary storage of potted products, comprising:

(a) opposing trays forming a top and bottom for said stackable crate, each of said trays having side walls and end walls, said side walls being orthogonal to said end walls to thereby define four corners for said opposing trays; and (b) support structures separating said opposing four cornered trays, each of said support structures having an interior upstanding wall segment and at least two exterior upstanding wall segments, said exterior upstanding wall segments each having an end defining an exterior corner for said stackable crate, said support structures configured relative to said opposing trays such that each of said exterior corners are in substantial abutting alignment with each of the corners of said opposing trays to thereby form substantially closed ends and partially open sides for said stackable crate, said partially open sides facilitating access to the interior storage space of said stackable crate and enhancing air flow through said stackable crate.

14. The stackable crate of claim 13 wherein said trays and said support structures are corrugated cardboard.

15. A stackable crate for storing, transporting, displaying and dispensing products comprising:

a base tray having a substantially planar support surface and a plurality of upstanding side walls surrounding the support surface;

a top tray having a substantially planar cover portion and a plurality of downwardly extending side walls;

a first support structures having a central support wall and a plurality of side support walls extending outwardly from opposite sides of the central support wall;

a second support structures having a central support wall and a plurality of side support walls extending outwardly from opposite sides of the central support wall;

wherein the first support structure and the second support structure nest within the side walls of the base tray and the top tray such that the central support wall of the first support structure and the central support wall of the second support structure are juxtaposed with one another and extend across the planar support surface of the base tray and are positioned perpendicular to the substantially planar support surface and the substantially planar cover portion.

16. The stackable crate of claim 15 wherein the plurality of side support walls of each support structure are adjacent the upstanding sidewalls.

17. The stackable crate of claim 15 further comprising a third support structure and a fourth support structure, each having a central support wall and a plurality of side support walls, wherein the central support wall of the third support structure and the central support wall of the fourth support structure are juxtaposed with one another and are positioned co-linearly with the central support wall of the first support structure and the central support wall of the second support structure.

18. The stackable crate of claim 15 wherein the plurality of side support walls comprises:

two end-side support walls which are attached to the central support and substantially perpendicular thereto; and two side-leg support walls which are attached to an end of the end-side support walls and extend substantially parallel with the central support wall.

19. The stackable crate of claim 18 wherein the end-side support walls and the side-leg support walls are all adjacent the upstanding sidewalls and downwardly extending sidewalls.

20. The stackable crate of claim 18 wherein said trays and said support structures are corrugated cardboard.

21. The stackable crate of claim 20 wherein the corrugated cardboard is substantially water resistant.

* * * * *

UNITED STATES PATENT AND TRADEMARK OFFICE

CERTIFICATE OF CORRECTION

PATENT NO. : 6,270,007 B1
DATED : August 7, 2001
INVENTOR(S) : Robert F. Jensen, Jr.

It is certified that error appears in the above-identified patent and that said Letters Patent is hereby corrected as shown below:

Title page,
Item [73] Assignee, delete "MI" and insert -- MN --

Column 5,
Line 40, delete "10a & 10b", and insert -- 10a & 10b --

Signed and Sealed this

Second Day of April, 2002

*Attest:*

*Attesting Officer*

JAMES E. ROGAN
*Director of the United States Patent and Trademark Office*